US012070659B2

(12) United States Patent
Van Heijst et al.

(10) Patent No.: US 12,070,659 B2
(45) Date of Patent: Aug. 27, 2024

(54) RACKET WITH A STRING TENSIONING DEVICE

(71) Applicant: Elevating Sports B.V., Hilversum (NL)

(72) Inventors: Arie Willem Van Heijst, Hilversum (NL); Tijn Pieter Lodewijk Huttenhuis, Oldenzaal (NL)

(73) Assignee: Elevating Sports B.V., Hilversum (NL)

( * ) Notice: Subject to any disclaimer, the term of this patent is extended or adjusted under 35 U.S.C. 154(b) by 431 days.

(21) Appl. No.: 17/481,434

(22) Filed: Sep. 22, 2021

(65) Prior Publication Data

US 2022/0088444 A1 Mar. 24, 2022

(30) Foreign Application Priority Data

Sep. 23, 2020 (EP) ..... 20197765

(51) Int. Cl.
*A63B 51/12* (2006.01)

(52) U.S. Cl.
CPC ..... *A63B 51/12* (2013.01)

(58) Field of Classification Search
CPC ..... A63B 51/12
See application file for complete search history.

(56) References Cited

U.S. PATENT DOCUMENTS 2,311,172 A 2/1943 Hetzel
3,904,202 A 9/1975 DeLorean
4,057,249 A * 11/1977 Reedhead ..... A63B 51/12 473/534
4,721,304 A 1/1988 Zavilenski, Jr.
4,783,072 A 11/1988 Haar
4,976,433 A * 12/1990 Pohlenz ..... A63B 51/12 473/534
2006/0166767 A1* 7/2006 Yanahara ..... A63B 51/12 473/553

FOREIGN PATENT DOCUMENTS

DE 3129207 A1 2/1983
EP 0231591 A2 8/1987
WO 9503856 A1 2/1995

* cited by examiner

*Primary Examiner* — Jeffrey S Vanderveen
(74) *Attorney, Agent, or Firm* — The Webb Law Firm

(57) ABSTRACT

Provided is a racket including a head portion connected to a handle portion. The head portion includes a beam including string holes and at least one string looped through the string holes, the racket further includes at least one tensioning device rotatably arranged on a support surface on the exterior surface of the beam relative to which it can be rotated between a first and a second position. The tensioning device includes a through hole arranged parallel and offset to the rotation axis and extending through the tensioning device. The at least one string is looped from a first string hole through the through hole to a second string hole, so that the tension of the at least one string can be varied by rotation of the tensioning device between the first and second position, and where the outer circumference of the tensioning device further includes a mating surface for mating with the support surface. The mating surface extends from a first mating patch which contacts the support surface in the first position to a second mating patch which contacts the support surface in the second position and where the cross section of the mating surface perpendicular to the rotation axis has an arched shape.

9 Claims, 2 Drawing Sheets

RACKET WITH A STRING TENSIONING DEVICE

CROSS-REFERENCE TO RELATED APPLICATION

This application claims priority to European Patent Application No. 20197765.9 filed Sep. 23, 2020, the disclosure of which is hereby incorporated by reference in its entirety.

BACKGROUND OF THE INVENTION

Field of the Invention

The invention relates to a racket with a string tensioning device.

Description of Related Art

Rackets are used for games such as for example tennis and badminton. The tension of the strings in the racket influence the playing characteristics of the racket. The optimal string tension is dependent on several factors and is thus subject to individual preference of the player.

U.S. Pat. No. 4,721,304A discloses a tension adjusting device for rackets. The system allows the player to adjust the tension of a number of strings while in the course of a match. By rotating a device having an off-center hole and irregular sides the string which through it passes is extended or allowed to contract thereby providing a difference in the play of the racket.

A disadvantage of the known racket with a tensioning device, is that the device has irregular sides on its rotating surface which allow the tensioning device to rest in intermediate positions. When the string is tensioned by rotating the device however, the tensioning device needs to be rotated over the irregular sides, all the while having to over-stretch the string as well. The required force is thus rather high.

SUMMARY OF THE INVENTION

It is an object of the invention to reduce or even alleviate the above-mentioned disadvantages.

This object is achieved according to the invention with a racket comprising a head portion connected to a handle portion, which head portion comprises a beam comprising string holes and at least one string looped through the string holes, the racket further comprising at least one tensioning device rotatably arranged on a support surface on the exterior surface of the beam relative to which it can be rotated between a first and a second position, which tensioning device comprises a through hole arranged parallel and offset to the rotation axis and extending through the tensioning device, wherein the at least one string is looped from a first string hole through the through hole to a second string hole, so that the tension of the at least one string can be varied by rotation of the tensioning device between the first and second position, and where the outer circumference of the tensioning device further comprises a mating surface for mating with the support surface, which mating surface extends from a first mating patch which contacts the support surface in the first position to a second mating patch which contacts the support surface in the second position and where the cross section of the mating surface perpendicular to the rotation axis has an arched shape.

Because the mating surface has an arched shape, there is no need to over-stretch the at least one string by rotating over irregularities as known from the state of the art.

The mating surface can extend all the way around the outer circumference of the tensioning device, in which case the first and second mating patch abut. Preferably though, the mating surface covers the maximum adjustment range between the first and the second position. The mating surface in that case extends at least across half of the circumference.

The position of the tensioning device is stable when the force induced by the string tension on the tensioning device does not result in a rotating torque over the rotation axis, for example when the through hole with the string, the rotation axis and the string holes lay within a single plane. Preferably the first and second position correspond with the positions in which the above-mentioned situation occurs, which typically occurs on the extremes of the adjustment range. One or both of the extremes of the adjustment range can however also occur in intermediate positions disposed between the first and second position.

The friction between the mating surface and support surface can furthermore be chosen such that the resulting friction torque is greater than the rotating torque acting on the tensioning device due to force induced through string tension across the arm between the rotation axis and the offset through hole. A tensioning device can then be positioned in a stable manner in intermediate positions. For adjusting, the friction torque needs to be overcome for allowing the tensioning device to rotate.

The support surface can be formed directly by the outer circumference of the beam, but a cradle or bracket can be added as well on the beam to form the support surface.

In another embodiment of a racket according to the invention, the support surface corresponds with at least one of the mating patches.

In order to increase the contact area or to further restrict movement of the tensioning device relative to the support surface, the support surface can be made to correspond with at least one of the mating patches. Preferably all mating patches correspond with the support surface.

Another embodiment of a racket according to the invention, is an embodiment in which the tensioning device comprises latching means for resisting rotating the tensioning device from at least one locking position.

As an alternative to or in conjunction with the friction torque, latching means can help resist rotating from at least one locking position. Preferably the first, second and any further number of intermediate positions are locking positions. The resistance against rotation delivered by the latching means can be adjusted for each locking position in order to achieve a consistent force required for rotating away from a locking position. The variable resistance against rotation can be direction dependent too in order to compensate for the increasing or decreasing string tension on rotating in a certain direction.

Another embodiment of a racket according to the invention, is an embodiment wherein the latching means comprise at least one protrusion disposed on an edge of the support surface, which at least one protrusion in the at least one locking position protrudes in at least one depression arranged on a first annular surface of the tensioning device and wherein the tensioning device can move laterally with respect to the support surface and in the direction of the rotation axis from a latched position to an unlatched position for unlatching the protrusion and depression.

By arranging a latching mechanism in the form of at least one interlocking pair of a protrusion and depression on a part of the tensioning device that doesn't interfere with the arched shape of the mating surface, the mating surface itself can remain smoothly arched. The first annular surface of the tensioning device lays against an upstanding edge of the support surface, at which contact area the latching of the protrusion and depression takes place.

It will be obvious that the respective locations of the protrusion and depression can be reversed while achieving the beneficial effect as claimed, which reversal is thus considered equivalent.

By allowing the tensioning device to move laterally with respect to the support surface and in the direction of the rotation axis, the latching mechanism can unlatch, allowing the tensioning device to rotate.

Alternatively, the required lateral movement for unlatching can also be provided by movement of the protrusion and/or edge comprising the protrusion, such that the protrusion or edge can move laterally with respect to the support surface and in the direction of the rotation axis from a latched position to an unlatched position for unlatching the protrusion and depression.

Also according to the invention, is an embodiment of a racket comprising a latching help such as a spring or compliant mechanism, which latching help laterally urges the tensioning device towards the latched position.

A latching help ensures the engagement of the latching means by urging the part that can laterally move from a latched to an unlatched position towards the latched position.

In a preferred embodiment of a racket according to the invention, the mating surface and support surface comprise a corresponding conical section for laterally urging the tensioning device towards the latched position.

A conically shaped mating surface and corresponding support surface induce a lateral force urging the tensioning device towards the latched position. The radius of the arc formed by the edge of the cross section of the mating surface perpendicular to the rotation axis should therefor increase in the direction of the latched position.

The mating surface can be conical across the entire width, but it is also possible that a conical section abuts a cylindrical section on one or both sides, which cylindrical sections have a diameter corresponding with the diameter of the conical section at the respective sides of the conical section.

Also according to the invention, is an embodiment of a racket wherein the outer circumference of the tensioning device comprises a receptacle for an adjustment tool for increasing leverage on rotating the tensioning device.

By including a receptacle for an adjustment tool, increased leverage can beneficially be obtained for rotating the tensioning device. The receptacle can be disposed near the edge of the mating surface or on an annular surface of the tensioning device. There can also be multiple receptacles across the circumference.

A further embodiment of a racket according to the invention, is an embodiment in which the receptacle is arranged between the first and second mating patch.

Beneficially, the receptacle is arranged between the first and second mating patch. This ensures the receptacle can be reached easily.

Another embodiment of a racket according to the invention, is a racket wherein the receptacle extends from the outer circumference of the tensioning device.

By extending the receptacle from the outer circumference, the strength of the receptacle can be increased. The extended receptacle can furthermore provide defined end-stops for the adjustment range, because the extended receptacle will interfere with the support surface, thereby preventing further rotation.

BRIEF DESCRIPTION OF THE DRAWINGS

These and other features of the invention will be elucidated in conjunction with the accompanying drawings.

DESCRIPTION OF THE INVENTION

Figure 1:
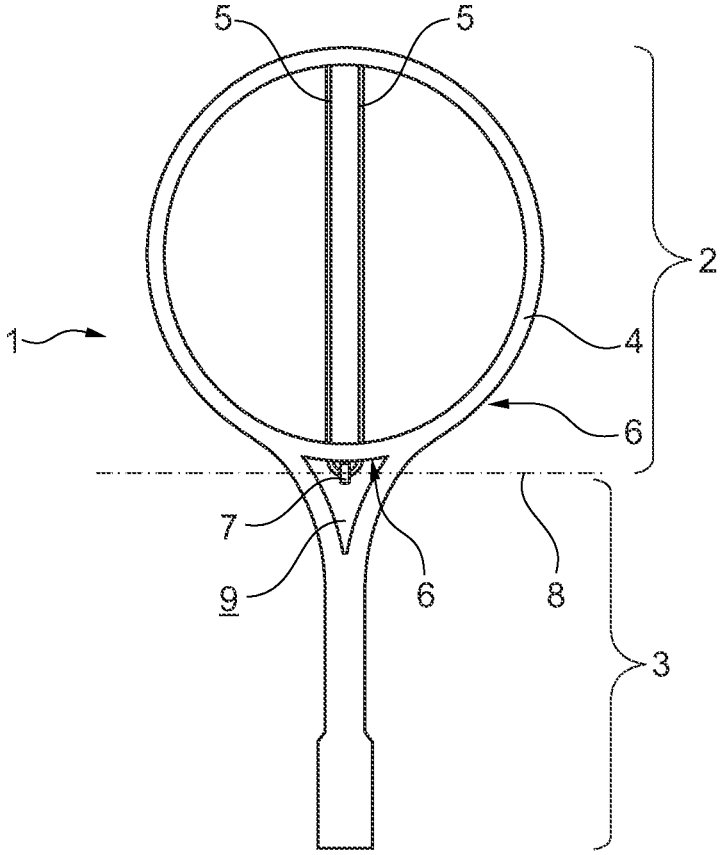
FIG. 1 shows a racket with a tensioning device according to the invention.

FIG. 1 shows a racket 1 according to the invention. The racket 1 has a head portion 2 connected to a handle portion 3. The beam 4 has string holes through which a string 5 is looped. On the outer circumference 6 of the beam 4, a tensioning device 7 is arranged through which the string 5 is looped. The tensioning device 7 is rotatable around the indicated rotation axis 8. The tensioning device 7 is located within the throat 9 of the racket 1, but can be located anywhere on the outer circumference 6 of the beam 4.

Figure 2:
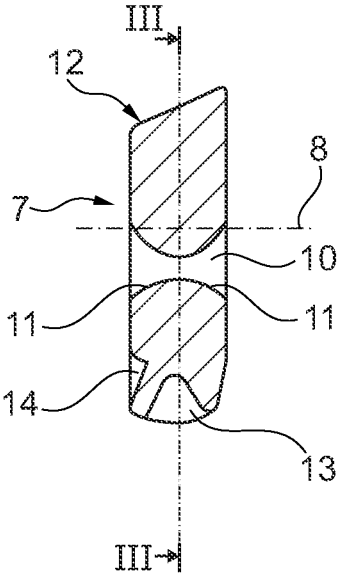
FIG. 2 shows a cross section of a tensioning device according to the invention across line II-II.
Figure 3:
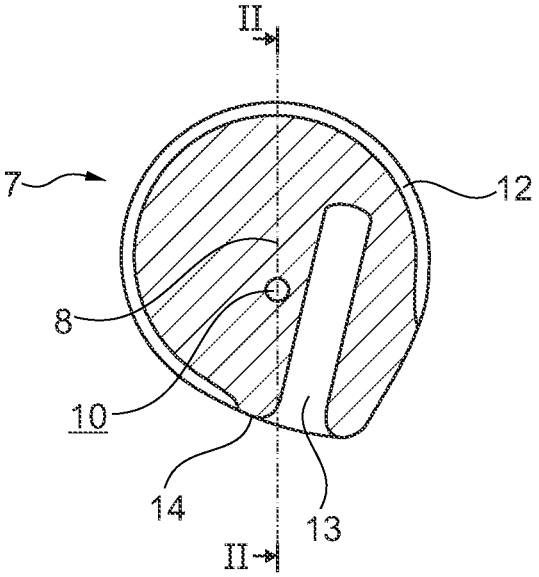
FIG. 3 shows a cross section of a tensioning device according to the invention across line III-III.

FIGS. 2 and 3 show a cross section of a tensioning device 7 according to the invention across line II-II respectively line III-III. The through hole 10 has a tapered opening 11 on both sides of the tensioning device 7 and is offset with respect to the rotation axis 8. The mating surface 12 is conical. A receptacle 13 for an adjustment tool is also shown, which receptacle 13 extends from the outer circumference 14 of the tensioning device 7.

Figure 4:
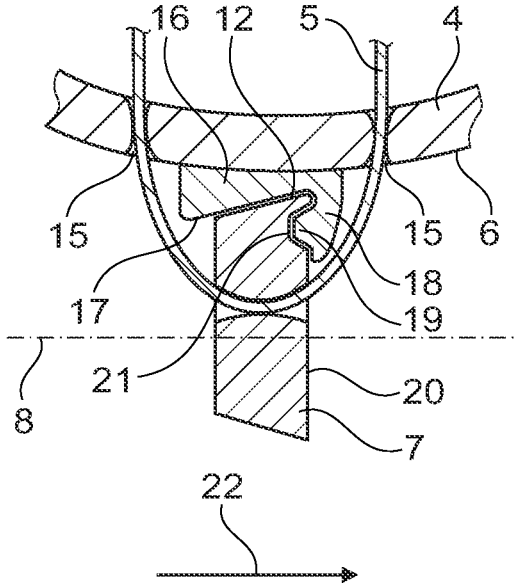
FIG. 4 schematically depicts a tensioning device on a support surface in the latched position.

FIG. 4 schematically depicts a cross section with a tensioning device 7 through which a string 5 is looped. The string 5 loops through string holes 15 arranged in the beam 4. On the outer circumference 6 of the beam 4 a bracket 16 is arranged. The bracket 16 has a support surface 17 and an edge 18 with a protrusion 19. On an annular surface 20 of the tensioning device 7, a depression 21 is formed. The conical mating surface 12 and support surface 17 urge the tensioning device 7 in the direction 22 of the arrow, resulting in the depicted latched position. As can be seen, the tensioning device 7 can move laterally in the direction opposite the direction 22 by laterally moving with respect to the support surface 17 of the bracket 16.

Figure 5:
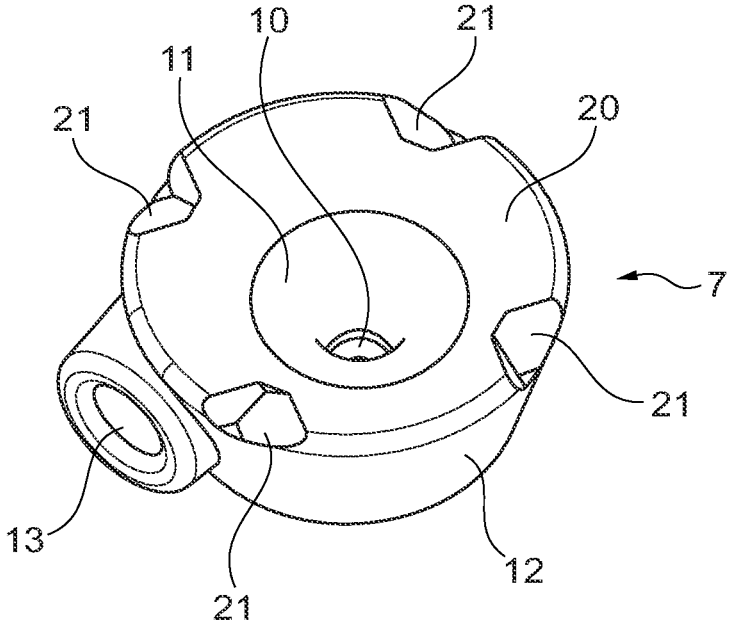
FIG. 5 shows a perspective view of a tensioning device according to the invention.

FIG. 5 shows a perspective view of a tensioning device 7 according to the invention. On the annular surface 20 four depressions 21 are arranged for locking the tensioning device 7 into discrete locking positions. The through hole 10 has a tapered entrance 11 for preventing unwanted stress in a string looped through the through hole 10. The conical mating surface 12 extends around the circumference of the tensioning device 7 from one end of the receptacle 13 to the other end of the receptacle 13.

The invention claimed is:

1. A racket comprising a head portion connected to a handle portion, which head portion comprises a beam comprising string holes and at least one string looped through the string holes, the racket further comprising at least one tensioning device rotatably arranged on a support surface on the exterior surface of the beam relative to which it can be rotated between a first and a second position, which tensioning device comprises a through hole arranged parallel and offset to the rotation axis and extending through the tensioning device, wherein the at least one string is looped from a first string hole through the through hole to a second string hole, so that the tension of the at least one string can be varied by rotation of the tensioning device between the first and second position, and where the outer circumference of the tensioning device further comprises a mating surface for mating with the support surface, which mating surface extends from a first mating patch which contacts the support surface in the first position to a second mating patch which contacts the support surface in the second position and where the cross section of the mating surface perpendicular to the rotation axis has an arched shape.

2. The racket according to claim 1, wherein the support surface corresponds with at least one of the mating patches.

3. The racket according to claim 1, wherein the tensioning device comprises latching means for resisting rotating the tensioning device from at least one locking position.

4. The racket according to claim 3, wherein the latching means comprise at least one protrusion disposed on an edge of the support surface, which at least one protrusion in the at least one locking position protrudes in at least one depression arranged on a first annular surface of the tensioning device and wherein the tensioning device can move laterally with respect to the support surface and in the direction of the rotation axis from a latched position to an unlatched position for unlatching the protrusion and depression.

5. The racket according to claim 4, comprising a latching help such as a spring or compliant mechanism, which latching help laterally urges the tensioning device towards the latched position.

6. The racket according to claim 4, wherein the mating surface and support surface comprise a corresponding conical section for laterally urging the tensioning device towards the latched position.

7. The racket according to claim 1, wherein the outer circumference of the tensioning device comprises a receptacle for an adjustment tool for increasing leverage on rotating the tensioning device.

8. The racket according to claim 7, wherein the receptacle is arranged between the first and second mating patch.

9. The racket according to claim 7, wherein the receptacle extends from the outer circumference of the tensioning device.

* * * * *